US005909137A

United States Patent [19]

Kimura

[11] Patent Number: 5,909,137

[45] Date of Patent: Jun. 1, 1999

[54] VOLTAGE ADDER/SUBTRACTOR CIRCUIT WITH TWO DIFFERENTIAL TRANSISTOR PAIRS

[75] Inventor: Katsuji Kimura, Tokyo, Japan

[73] Assignee: NEC Corporation, Tokyo, Japan

[21] Appl. No.: 08/914,167

[22] Filed: Aug. 19, 1997

[30] Foreign Application Priority Data

Aug. 19, 1996 [JP] Japan ..... 8-217223

[51] Int. Cl.[6] ..... G06G 7/16

[52] U.S. Cl. ..... 327/359; 327/355

[58] Field of Search ..... 327/52, 55, 56, 327/63, 65, 70, 89, 90, 352, 355, 359, 361, 427, 432, 434, 437, 562, 563; 364/841; 330/252, 261

[56] References Cited

U.S. PATENT DOCUMENTS

| | | | |
|---|---|---|---|
| 4,965,468 | 10/1990 | Nicollini et al. | 327/65 |
| 5,444,648 | 8/1995 | Kimura | 364/841 |
| 5,517,134 | 5/1996 | Yaklin | 327/63 |
| 5,576,653 | 11/1996 | Kimura | 327/356 |
| 5,581,210 | 12/1996 | Kimura | 327/355 |
| 5,712,810 | 1/1998 | Kimura | 364/841 |

FOREIGN PATENT DOCUMENTS 2133596 7/1984 United Kingdom .

*Primary Examiner*—My-Trang Nu Ton
*Attorney, Agent, or Firm*—Sughrue, Mion, Zinn, Macpeak & Seas, PLLC

[57] ABSTRACT

A voltage adder/subtractor circuit is provided, which has an improved frequency characteristic and which is operable at a low supply voltage such as approximately 1.1 V. This circuit includes a first differential pair of emitter/source-coupled first and second transistors driven by a first constant current, and a second differential pair of emitter/source-coupled third and fourth transistors driven by a second constant current having a same current value as that of the first constant current. A third constant current source/sink serving as a common load for the second and third transistors is connected to the collector/drain of the second transistor and the coupled collector/drain and base/gate of the third transistor. The third constant current source/sink supplies/sinks a third constant current having a same current value as that of the first constant current. A first input voltage is differentially applied across bases/gates of the first and second transistors. A second input voltage is applied to a base/gate of the fourth transistor. An output voltage is derived from the base/gate of the third transistor.

4 Claims, 3 Drawing Sheets

VOLTAGE ADDER/SUBTRACTOR CIRCUIT WITH TWO DIFFERENTIAL TRANSISTOR PAIRS

BACKGROUND OF THE INVENTION

1. Field of the Invention

The present invention relates to a voltage adder/subtractor circuit and more particularly, to a voltage adder/subtractor circuit performing addition or subtraction of two input voltages, which has two differential pairs of bipolar or Metal-Oxide-Semiconductor Field-Effect Transistors (MOSFETS) and which is formed on a semiconductor integrated circuit (IC).

2. Description of the Prior Art

FIG. 1 shows a conventional bipolar voltage adder circuit.

In FIG. 1, a first differential pair is formed by npn bipolar transistors Q101 and Q102 whose emitters are coupled together. The emitters of the transistors Q101 and Q102 are the same in size and therefore, the first differential pair is a balanced emitter-coupled transistor pair.

The coupled emitters of the transistors Q101 and Q102 are connected to a terminal of a constant current sink 101 sinking a constant current $I_0$. The other terminal of the current sink 101 is connected to the ground. The first differential pair of the transistors Q101 and Q102 is driven by the constant current $I_0$.

Bases of the transistors Q101 and Q102 are connected to a pair of input terminals T101 and T102, respectively. A first input voltage $V_1$ is differentially applied across the bases of the transistors Q101 and Q102 through the pair of input terminals T101 and T102. The polarity of the voltage $V_1$ is defined as positive when the electrical potential at the terminal T101 is higher than that at the terminal T102.

Diode-connected pnp bipolar transistors Q105 and Q107 are connected to the transistors Q101 and Q102 as their loads, respectively. A base and a collector of the transistor Q105 are coupled together to be connected to a collector of the transistor Q101. An emitter of the transistor Q105 is connected to a power supply (not shown) supplying a constant dc voltage $V_{cc}$. A base and a collector of the transistor Q107 are coupled together to be connected to a collector of the transistor Q102. An emitter of the transistor Q107 is connected to the power supply.

A second differential pair is formed by npn bipolar transistors Q103 and Q104 whose emitters are coupled together. The emitters of the transistors Q103 and Q104 are the same in size as those of the transistors Q101 and Q102 and therefore, the second differential pair is also a balanced emitter-coupled transistor pair.

The coupled emitters of the transistors Q103 and Q104 are connected to a terminal of a constant current sink 102 sinking the same constant current $I_0$ as that of the constant current sink 101. The other terminal of the current sink 102 is connected to the ground. The second differential pair of the transistors Q103 and Q104 is driven by the same constant current $I_0$ as that of the first differential pair.

A base and a collector of the transistor Q103 are coupled together, i.e., the transistors Q103 has a diode-connection. The coupled base and collector of the transistor Q103 are connected to an output terminal T103. An output voltage $V_0$ is derived from the coupled base and collector of the transistor Q103 through the output terminal T103. The polarity of the voltage $V_0$ is defined as positive when the electrical potential at the terminal T103 is higher than that at the ground.

A base of the transistor Q104 is connected to an input terminal T104. A second input voltage $V_2$ is applied to the base of the transistor Q104 through the input terminal T104. The polarity of the voltage $V_2$ is defined as positive when the electrical potential at the terminal T104 is higher than that at the ground.

A pnp bipolar transistor Q106 is connected to the transistor Q103 at its load. A collector of the transistor Q106 is connected to the coupled collector and base of the transistor Q103. An emitter of the transistor Q105 is connected to the power supply. A base of the transistor Q106 is connected to the coupled base and collector of the transistor Q105 in the first differential pair, thereby constituting a current mirror circuit. This current mirror circuit makes a collector current of the transistor Q101 to be equal to a collector current of the transistor Q103.

A diode-connected pnp bipolar transistor Q108 is connected to the transistor Q104 as its load. A base and a collector of the transistor Q108 are coupled together to be connected to a collector of the transistor Q104. An emitter of the transistor Q108 is connected to the power supply.

The diode-connected transistors Q107 and Q108 are inserted for the purpose of making the voltages at the collectors of the transistors Q102 and Q104 equal with those at the collectors of the transistors Q101 and Q103. Thus, the operating characteristic matching for the first and second differential pairs is improved.

Ignoring the base-width modulation due to the Early effect, a collector current $I_c$ and a base-to-emitter voltage $V_{BB}$ of a bipolar transistor have, in general, the following relationship (1).

$$I_C = I_S \exp\left(\frac{V_{BE}}{V_T}\right) \tag{1}$$

In the equation (1), $V_T$ and $I_s$ are the thermal voltage and the saturation current of a bipolar transistor, respectively. The thermal voltage $V_T$ is defined as $V_T$=[(kT)/q], where k is the Boltzmann's constant, T is absolute temperature in degrees Kelvin, and q is the charge of an electron.

Here, the following circuit analysis is made on the supposition that the dc common-base current gain factor $\alpha_F$ is set as unity (i.e., $\alpha_F$=1) and thus, no base current flows through the transistor for the sake of the simplification of description.

Using the above relationship (1), collector currents $I_{C1}$, $I_{C2}$, $I_{C3,\ and\ IC4}$ of the transistors Q101, Q102, Q103, and Q104 are expressed as the following equations (2), (3), (4), and (5), respectively.

$$I_{C1} = \frac{I_0}{2}\left\{1 + \tanh\left(\frac{V_1}{2V_T}\right)\right\} \tag{2}$$

$$I_{C2} = \frac{I_0}{2}\left\{1 - \tanh\left(\frac{V_1}{2V_T}\right)\right\} \tag{3}$$

$$I_{C3} = \frac{I_0}{2}\left\{1 + \tanh\left(\frac{V_O - V_2}{2V_T}\right)\right\} \tag{4}$$

$$I_{C4} = \frac{I_0}{2}\left\{1 + \tanh\left(\frac{V_2 - V_O}{2V_T}\right)\right\} \tag{5}$$

Since the collector of the transistor Q101 is connected to the collector of the transistor Q103 through the current mirror circuit formed by the transistors Q105 and Q106, the following equation (6) is established.

$$I_{C1}=I_{C3} \tag{6}$$

The equation (6) means that the right side of the equation (2) is equal to the right side of the equation (4), resulting in a relationship of $V_1=V_0-V_2$.

Consequently, the following equation (7) is obtained.

$$V_0=V_1+V_2 \tag{7}$$

The equation (7) indicates that the output voltage $V_0$ is equal to the sum of the first and second input voltages $V_1$ and $V_2$. Thus, it is seen that the circuit shown in FIG. 1 has a function of adding the two input voltages $V_1$ and $V_2$.

FIG. 2 shows a conventional MOS voltage subtractor circuit.

In FIG. 2, a first differential pair is formed by n-channel MOSFETs M101 and M102 whose sources are coupled together. The gate-width (W) to gate-length (L) ratio (W/L) of the MOSFETs M101 and M102 are the same and therefore, the first differential pair is a balanced source-coupled transistor pair.

The coupled sources of the MOSFETs M101 and M102 are connected to a terminal of a constant current sink 111 sinking a constant current $I_0$. The other terminal of the current sink 111 is connected to the ground. The first differential pair of the MOSFETs M101 and M102 is driven by the constant current $I_0$.

Gates of the MOSFETs M101 and M102 are connected to a pair of input terminals T101 and T102, respectively. A first input voltage $V_1$ is differentially applied across the gates of the MOSFETs M101 and M102 through the pair of input terminals T101 and T102 The polarity of the voltage $V_1$ is defined as positive when the electrical potential at the terminal T101 is higher than that at the terminal T102.

Diode-connected p-channel MOSFETs M105 and M107 are connected to the MOSFETs M101 and M102 as their loads, respectively. A gate and a drain of the MOSFET M105 are coupled together to be connected to a drain of the MOSFET M102. A source of the MOSFET M105 is connected to a power supply (not shown) providing a supply voltage $V_{DD}$. A gate and a drain of the MOSFET M107 are coupled together to be connected to a drain of the MOSFET M101. A source of the MOSFET M107 is connected to the power supply.

A second differential pair is formed by n-channel MOSFETs M103 and M104 whose sources are coupled together. The gate-width (W) to gate-length (L) ratio (W/L) of the MOSFETs M103 and M104 are the same and therefore, the second differential pair is also a balanced source-coupled transistor pair.

The coupled sources of the MOSFETs M103 and M104 are connected to a terminal of a constant current sink 112 sinking the same constant current $I_0$ as that of the constant current sink 111. The other terminal of the current sink 112 is connected to the ground. The second differential pair of the MOSFETs M103 and M104 is driven by the same constant current $I_0$ as that of the first differential pair.

A gate and a drain of the MOSFET M103 are coupled together, the MOSFET M103 has a diode-connection. The coupled gate and drain of the MOSFET M103 are connected to an output terminal T103. An output voltage $V_0$ is derived from the coupled gate and drain of the MOSFET M103 through the output terminal T103. The polarity of the voltage $V_0$ is defined as positive when the electrical potential at the terminal T103 is higher than that at the ground.

A gate of the MOSFET M104 is connected to an input terminal T104. A second input voltage $V_2$ is applied to the gate of the MOSFET M104 through the input terminal T104. The polarity of the voltage $V_2$ is defined as positive when the electrical potential at the terminal T104 is higher than that at the ground.

A p-channel MOSFET M106 is connected to the MOSFET M103 as its load. A drain of the MOSFET M106 is connected to the coupled drain and gate of the MOSFET M103. A source of the MOSFET M106 is connected to the power supply. A gate of the MOSFET M106 is connected to the coupled gate and drain of the MOSFET M105 in the first differential pair, thereby constituting a current mirror circuit. This current mirror circuit makes a drain current of the MOSFET M102 to be equal to a drain current of the MOSFET M103.

A diode-connected p-channel MOSFET M108 is connected to the MOSFET M104. A gate and a drain of the MOSFET M108 are coupled together to be connected to a drain of the MOSFET 104. A source of the MOSFET M108 is connected to the power supply.

The diode-connected MOSFETs M107 and M108 are inserted for the purpose of making the voltages at the drains of the MOSFETs M101 and M104 equal with those at the drains of the MOSFETs M102 and M103. Thus, the operating characteristic matching for the first and second differential pairs is improved.

Ignoring the channel-length modulation and the body effect, and supposing the square-law characteristic between a drain current $I_D$ of a MOSFET and a gate-to-source voltage $V_{GS}$ thereof, the drain current $I_D$ and the gate-to-source voltage $V_{GS}$ have, in general, the following relationships (8*a*) and (8*b*).

$$I_D = \beta(V_{GS} - V_{TH})^2 \quad (V_{GS} \geqq V_{TH}) \tag{8a}$$

$$I_D = 0 \quad (V_{GS} \leqq V_{TH}) \tag{8b}$$

In the equation (8*a*), β is the transconductance parameter and $V_{TH}$ is the threshold voltage of a MOSFET. The transconductance parameter β is expressed as $\mu(C_{ox}/2)$ (W/L), where $\mu$ is the effective carrier mobility, $C_{ox}$ is the gate-oxide capacitance per unit area, and W and L are a gate-width and a gate-length of a MOSFET, respectively.

Accordingly, drain currents $I_{D1}$, $I_{D2}$, $I_{D3}$, and $I_{D4}$ of the MOSFETs M101, M102, M103, and M104 are expressed as the following equations (9), (10), (11), and (12), respectively.

$$I_{D1} = \frac{1}{2}\left\{I_0 + \beta V_1\sqrt{\frac{2I_0}{\beta} - V_1^2}\right\} \tag{9}$$

$$I_{D2} = \frac{1}{2}\left\{I_0 - \beta V_1\sqrt{\frac{2I_0}{\beta} - V_1^2}\right\} \tag{10}$$

$$I_{D3} = \frac{1}{2}\left\{I_0 - \beta(V_2 - V_O)\sqrt{\frac{2I_0}{\beta} - (V_2 - V_O)^2}\right\} \tag{11}$$

$$I_{D4} = \frac{1}{2}\left\{I_0 + \beta(V_2 - V_O)\sqrt{\frac{2I_0}{\beta} - (V_2 - V_O)^2}\right\} \tag{12}$$

Since the drain of the MOSFET M102 is connected to the drain of the MOSFET M103 through the current mirror circuit formed by the MOSFETs M105 and M106, the following equation (13) is established.

$$I_{D2}=I_{D3} \tag{13}$$

The equation (13) means that the right side of the equation (10) is equal to the right side of the equation (11), resulting in a relationship of $V_1=V_2-V_0$.

Consequently, the following equation (14) is obtained.

$$V_0=-V_1+V_2 \quad (14)$$

The equation (14) indicates that the output voltage $V_0$ is equal to the difference of the first and second input voltages $V_1$ and $V_2$. Thus, it is seen that the circuit shown in FIG. 2 has a function of subtracting the first input voltage $V_1$ from the second input voltage $V_2$.

Unlike the equation (7), the polarity of the first input voltage $V_1$ is negative in the equation (14). This is because the MOSFET M105 is not connected to the MOSFET M101 but the MOSFET M102. The polarity of the first input voltage $V_1$ may be readily turned to be positive by replacing the MOSFET M105 with the MOSFET M107. Therefore, it is seen that the circuit shown in FIG. 2 may be changed to a voltage adder circuit.

A voltage adder circuit and a voltage subtractor circuit form essential and frequently-used functional blocks in analog signal processing. Especially, in recent years, the need for a voltage adder/subtractor circuit that is operable at a possibly-low supply voltage and superior in frequency characteristic has been becoming stronger and stronger. From this viewpoint, the above-described conventional voltage adder and subtractor circuits in FIGS. 1 and 2 have the following problems.

Specifically, with the conventional voltage adder and subtractor circuits shown in FIGS. 1 and 2, a signal current is supplied from the first differential pair to the second differential pair through the current mirror circuit formed by the pnp bipolar transistors Q105 and Q106 or p-channel MOSFETs M105 and M106, respectively. As a result, the linear range of the frequency characteristic is unsatisfactorily narrow.

Moreover, with the conventional bipolar voltage adder circuit shown in FIG. 1, the voltages need to be approximately equal at the collectors of the transistors Q101, Q102, Q103, and Q104 forming the first and second differential pairs for the purpose of matching the operations of the first and second differential pairs. For this reason, the power supply voltage $V_{cc}$ is required to be considerably high.

For example, if each of the constant current sinks 101 and 102 is composed of a simplest current mirror circuit including only two bipolar transistors, it has the inter-terminal voltage of at lowest 0.2 V. Also, each of the transistors Q101, Q102, Q103, Q104, Q105, Q106, Q107, and Q108 typically has the base-to-emitter voltage of approximately 0.7 V. Therefore, the power supply voltage $V_{cc}$ needs to be approximately 1.6 V (=0.7+0.7+0.2) at lowest.

Similarly, with the conventional MOS voltage subtractor circuit shown in FIG. 2, the voltages need to be approximately equal at the drains of the MOSFETs M101, M102, M103, and M104 forming the first and second differential pairs for the purpose of matching the operations of the first and second differential pairs. For this reason, the power supply voltage VDD is required to be considerably high.

SUMMARY OF THE INVENTION

Accordingly, an object of the present invention is to provide a voltage adder/subtractor circuit that has a wider linear range of the frequency characteristic and operates at a low supply voltage such as approximately 1.1 V.

The above object together with others not specifically mentioned will become clear to those skilled in the art from the following description.

A voltage adder/subtractor circuit according to a first aspect of the present invention includes a first differential pair of first and second bipolar transistors whose emitters are coupled together, a first constant current source/sink for driving the first differential pair by a first constant current, a second differential pair of third and fourth transistors whose emitters are coupled together, and a second constant current source/sink for driving the second differential pair by a second constant current having a same current value as that of the first constant current.

A base and a collector of the third transistor are coupled together to form a diode connection. The coupled collector and base of the third transistor are connected to a collector of the second transistor.

A third constant current source/sink serving as a common load for the second and third transistors is connected to the collector of the second transistor and the coupled collector and base of the third transistor. The third constant current source/sink supplies/sinks a third constant current having a same current value as that of the first constant current.

A first input voltage is differentially applied across bases of the first and second transistors. A second input voltage is applied across a base of the fourth transistor and a reference point at a reference electric potential. An output voltage is derived between the base of the third transistor and the reference point.

With the voltage adder/subtractor circuit according to the first aspect of the present invention, the third constant current source/sink serving as a common load for the second and third transistors is connected to the collector of the second transistor and the coupled collector and base of the third transistor. The third constant current source/sink supplies/sinks the third constant current having the same current value as that of the first and second constant currents.

Therefore, an electric signal is not transmitted between the first and second differential pairs through the third constant current source/sink. This means that the frequency characteristic has a wide linear range.

Further, the third constant current source/sink, a necessary operating voltage of which may be lower than a typical current mirror circuit, is provided as a common load for the second and third transistors. Consequently, the necessary supply voltage is decreased to, for example, approximately 1.1 V.

A voltage adder/subtractor circuit according to a second aspect of the present invention includes a first differential pair of first and second MOSFETs whose sources are coupled together, a first constant current source/sink for driving the first differential pair by a first constant current, a second differential pair of third and fourth MOSFETs whose sources are coupled together, and a second constant current source/sink for driving the second differential pair by a second constant current having a same current value as that of the first constant current.

A gate and a drain of the third MOSFET are coupled together to form a diode connection. The coupled drain and gate of the third MOSFET are connected to a drain of the second MOSFET.

A third constant current source/sink serving as a common load for the second and third MOSFETs is connected to the drain of the second MOSFET and the coupled drain and gate of the third MOSFET. The third constant current source/sink supplies/sinks a third constant current having a same current value as that of the first constant current.

A first input voltage is applied across gates of the first and second MOSFETs. A second input voltage is applied across a gate of the fourth MOSFET and a reference point at a reference electric potential. An output voltage is derived between the gate of the third MOSFET and the reference point.

Because the voltage adder/subtractor circuit according to the second aspect of the present invention corresponds to a circuit obtained by replacing the first to third bipolar transistors with the first to third MOSFETs, respectively, there are the same advantages as those in the circuit according to the first aspect.

In the circuits according to the first and second aspects of the present invention, any constant current source/sink may be used as each of the first to third constant current sources/sinks. However, it is preferred that a constant current source/sink the inter-terminal voltage of which is as low as possible is used.

In a preferred embodiment of the circuits according to the first and second aspects, a voltage level shifter is additionally provided to make collector/drain voltages of the first and fourth bipolar transistors or MOSFETs equal with those of the second and third transistors or MOSFETs. In this case, there is an additional advantage that operation characteristics of the first and second differential pairs are further matched.

Any constant voltage source may be used as the voltage level shifter.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
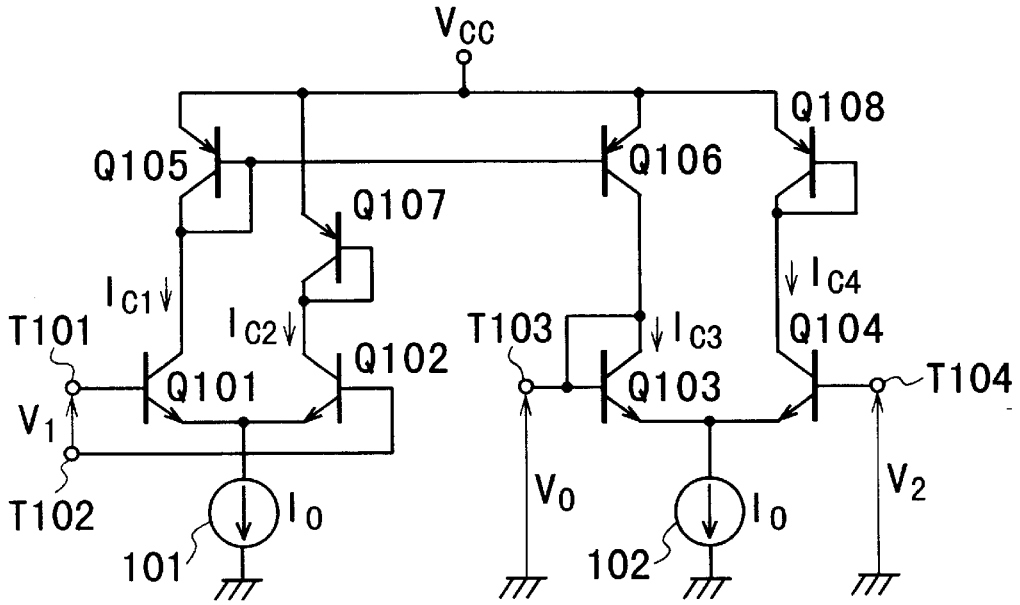
FIG. 1 PRIOR ART
FIG. 1 is a circuit diagram showing a conventional bipolar voltage adder circuit.

Preferred embodiments of the present invention will be described below referring to the drawings attached.

FIRST EMBODIMENT

Figure 3:
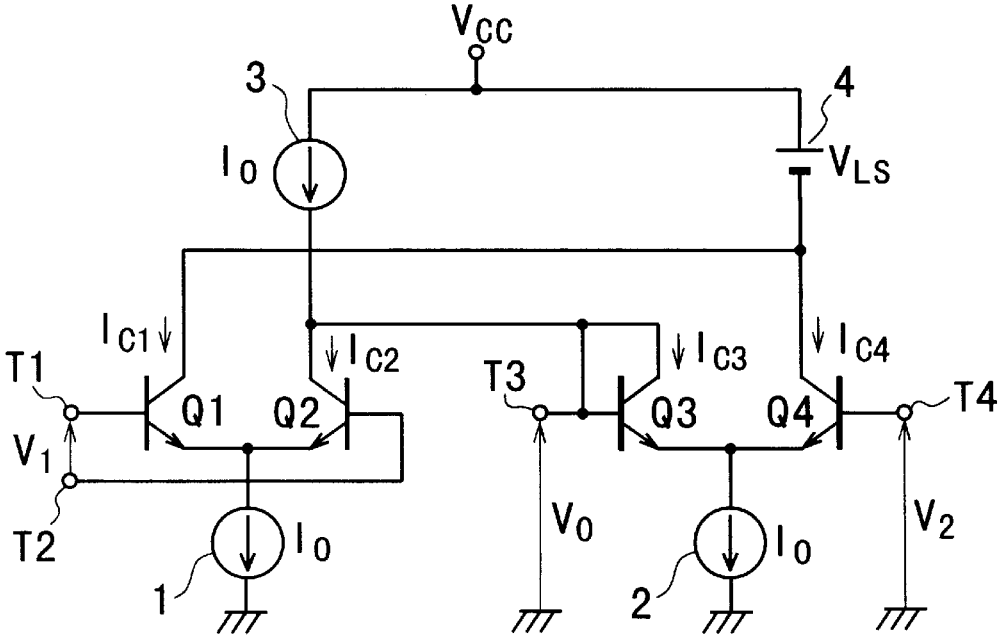
FIG. 3 is a circuit diagram showing a bipolar voltage adder circuit according to a first embodiment of the present invention.

A voltage adder circuit according to a first embodiment of the present invention has a configuration as shown in FIG. 3.

In FIG. 3, a first differential pair is formed by npn bipolar transistors Q1 and Q2 whose emitters are coupled together. The emitters of the transistors Q1 and Q2 are the same in size and therefore, the first differential pair is a balanced emitter-coupled transistor pair.

The coupled emitters of the transistors Q1 and Q2 are connected to a terminal of a constant current sink 1 sinking a constant current $I_0$. The other terminal of the current sink 1 is connected to the ground. The first differential pair of the transistors Q1 and Q2 is driven by the constant current $I_0$.

Bases of the transistors Q1 and Q2 are connected to a pair of input terminals T1 and T2, respectively. A first input voltage $V_1$ is differentially applied across the bases of the transistors Q1 and Q2 through the pair of input terminals T1 and T2. The polarity of the voltage $V_1$ is defined as positive when the electrical potential at the terminal T1 is higher than that at the terminal T2.

A second differential pair is formed by npn bipolar transistors Q3 and Q4 whose emitters are coupled together. The emitters of the transistors Q3 and Q4 are the same in size as those of the transistors Q1 and Q2 and therefore, the second differential pair is also a balanced emitter-coupled transistor pair.

The coupled emitters of the transistors Q3 and Q4 are connected to a terminal of a constant current sink 2 sinking the same constant current $I_0$ as that of the constant current sink 1. The other terminal of the current sink 2 is connected to the ground. The second differential pair of the transistors Q3 and Q4 is driven by the same constant current $I_0$ as that of the first differential pair.

A base and a collector of the transistor Q3 are coupled together, i.e., the transistor Q3 has a diode-connection. The coupled base and collector of the transistor Q3 are connected to an output terminal T3. An output voltage $V_0$. is derived from the coupled base and collector of the transistor Q3 through the output terminal T3. The polarity of the voltage $V_0$ is defined as positive when the electrical potential at the terminal T3 is higher than that at the ground.

A base of the transistor Q4 is connected to an input terminal T4. A second input voltage $V_2$ is applied to the base of the transistor Q4 through the input terminal T4. The polarity of the voltage $V_2$ is defined as positive when the electrical potential at the terminal T4 is higher than that at the ground.

A collector of the transistor Q1 is connected to a collector of the transistor Q4. A collector of the transistor Q2 is connected to a collector of the transistor Q3. Therefore, the collectors or output terminals of the transistors Q1 and Q2 of the first differential pair and those of the second differential pair are cross-coupled.

A terminal of a constant current source 3, which supplies a same constant current $I_0$ as that of the current sinks 1 and 2, is connected to the coupled collectors of the transistors Q2 and Q3. Another terminal of the constant current source 3 is connected to a power supply (not shown) providing a supply voltage $V_{cc}$. The constant current source 3 serves as a common active load for the two transistors Q2 and Q3.

A negative terminal of a constant voltage source 4, which supplies a constant dc voltage $V_{LS}$, is connected to the coupled collectors of the transistors Q1 and Q4 Another terminal of the constant voltage source 4 is connected to the power supply. The constant voltage source 4 serves as a common voltage-level shifter for the two transistors Q1 and Q4, thereby making the voltages at the collectors of the transistors Q1 and Q4 equal to those at the collectors of the transistors Q2 and Q3. Thus, the characteristic matching for the first and second differential pairs is improved.

With the voltage adder circuit according to the first embodiment, similar to the conventional one shown in FIG. 1, collector currents $I_{C1}$, $I_{C2}$, $I_{C3}$, and $I_{C4}$ of the transistors Q1, Q2, Q3, and Q4 can be expressed as the previously-described equations (2), (3), (4), and (5), respectively.

In this embodiment, the constant current source 3 providing the same constant current Io as the tail currents of the first and second differential pairs is inserted as the common load for the transistors Q2 and Q3 and therefore, the following equation (15) is established.

$$I_{C2}+I_{C3}=I_0 \tag{15}$$

Substituting the above equations (3) and (4) into the equation (15) gives the following equation.

$$\tanh\left(\frac{V_1}{2V_T}\right)=\tanh\left(\frac{(V_O-V_2)}{2V_T}\right) \tag{7'}$$

The equation (7') can be rewritten to the above equation (7) As a result, it is seen that the circuit in FIG. 3 has a voltage adder function.

To improve the characteristic matching for the first and second differential pairs, it is necessary to make the collector voltages of the transistors Q1 and Q4 equal to those of the transistors Q2 and Q3. If the inter-terminal voltage of the constant current source 3 is set as 0.2 V, the voltage $V_{LS}$ of the constant voltage source 4 needs to be set as 0.2 V.

Each of the transistors Q1 Q2, Q3, and Q4 may have the lowest base-to-emitter voltage of approximately 0.7 V. Therefore, it is sufficient for normal voltage adder operation that the supply voltage $V_{cc}$ is equal to approximately 1.1 V (=0.2+0.7+0.2) or higher. This is lower than that of the conventional voltage adder circuit shown in FIG. 1 by approximately 0.5 V.

Moreover, even if the constant current source 3 serving as the common active load is formed by pap bipolar transistors, no signal current flows through the current source 3. This means that the frequency characteristic is difficult to degrade. Consequently, the linear range of the frequency characteristic of the voltage adder circuit according to the first embodiment becomes wider than the conventional voltage adder circuit shown in FIG. 1.

SECOND EMBODIMENT

Figure 4:
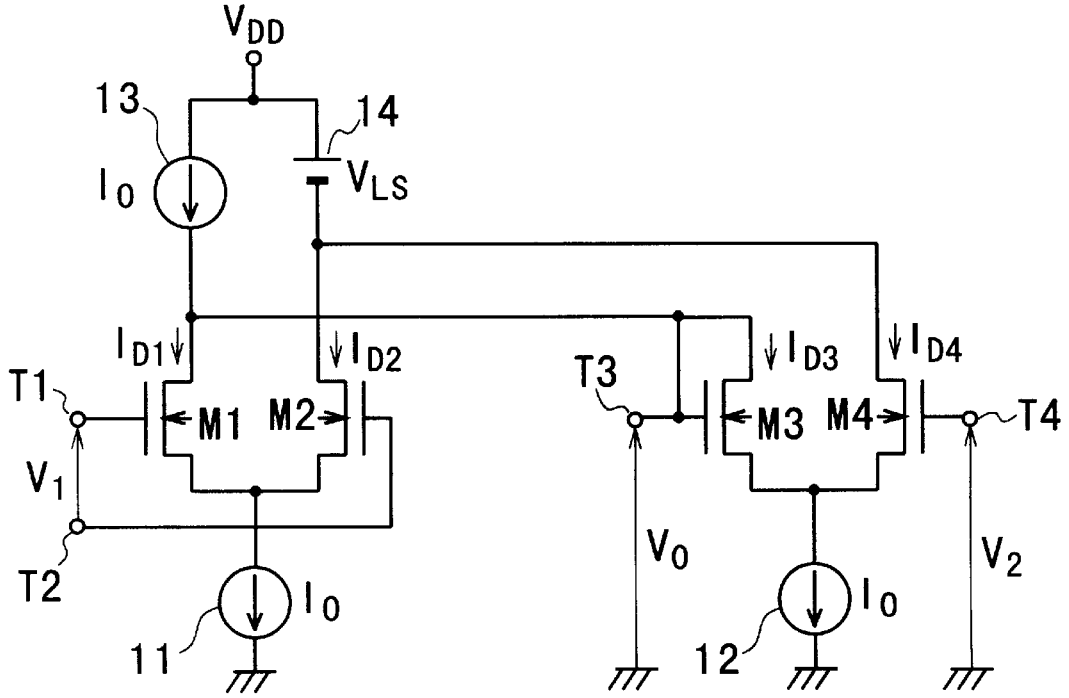
FIG. 4 is a circuit diagram showing a MOS voltage subtractor circuit according to a second embodiment of the present invention.

A voltage subtractor circuit according to a second embodiment of the present invention has a configuration as shown in FIG. 4.

In FIG. 4, a first differential pair is formed by n-channel MOSFETs M1 and M2 whose sources are coupled together. The gate-width (W) to gate-length (L) ratio (W/L) of the MOSFETs Ml and M2 are the same and therefore, the first differential pair is a balanced source-coupled transistor pair.

The coupled sources of the MOSFETs M1 and M2 are connected to a terminal of a constant current sink 11 sinking a constant current $I_0$. The other terminal of the current sink 11 is connected to the ground. The first differential pair of the MOSFETs M1 and M2 is driven by the constant current $I_0$.

Gates of the MOSFETs M1 and M are connected to a pair of input terminals T1 and T2, respectively. A first input voltage $V_1$ is differentially applied across the gates of the MOSFETs M1 and M2 through the pair of input terminals T1 and T2. The polarity of the voltage $V_1$ is defined as positive when the electrical potential at the terminal T1 is higher than that at the terminal T2.

A second differential pair is formed by n-channel MOSFETs M3 and M4 whose sources are coupled together. The gate-width (W) to gate-length (L) ratio (W/L) of the MOSFETs M3 and M4 are the same as those of the MOSFETs M1 and M2 and therefore, the second differential pair is also a balanced source-coupled transistor pair.

The coupled sources of the MOSFETs M3 and M4 are connected to a terminal of a constant current sink 12 sinking the same constant current $I_0$ as that of the constant current sink 11. The other terminal of the current sink 12 is connected to the ground. The second differential pair of the MOSFETs M3 and M4 is driven by the same constant current $I_0$ as that of the first differential pair.

A gate and a drain of the MOSFET M3 are coupled together, i.e., the MOSFET M3 has a diode-connection. The coupled gate and drain of the MOSFET M3 are connected to an output terminal T3. An output voltage $V_0$ is derived from the coupled gate and drain of the MOSFET M3 through the output terminal T3. The polarity of the voltage $V_0$ is defined as positive when the electrical potential at the terminal T3 is higher than that at the ground.

A gate of the MOSFET M4 is connected to an input terminal T4. A second input voltage $V_2$ is applied to the gate of the MOSFET M4 through the input terminal T4. The polarity of the voltage $V_2$ is defined as positive when the electrical potential at the terminal T4 is higher than that at the ground.

A drain of the MOSFET M1 is connected to a drain of the MOSFET M4. A drain of the MOSFET M2 is connected to a drain of the MOSFET M3. Therefore, the drains or output terminals of the MOSFETs M1 and M2 of the first differential pair and those of the second differential pair are cross-coupled.

A terminal of a constant current source 13, which supplies a same constant current $I_0$ as that of the current sinks 11 and 12, is connected to the coupled drains of the MOSFETs M1 and M3. Another terminal of the constant current source 13 is connected to a power supply (not shown) providing a supply voltage $V_{DD}$. The constant current source 13 serves as a common active load for the two MOSFETs M1 and A negative terminal of a constant voltage source 14, which supplies a constant dc voltage $V_{LS}$, is connected to the coupled drains of the MOSFETs M2 and M4. Another terminal of the constant voltage source 14 is connected to the power supply. The constant voltage source 14 serves as a common voltage-level shifter for the two MOSFETs M2 and M4, thereby making the voltages at the drains of the MOSFETs M2 and M4 with those of the MOSFETs M1 and M3. Thus, the characteristic matching for the first and second differential pairs is improved.

Figure 2:
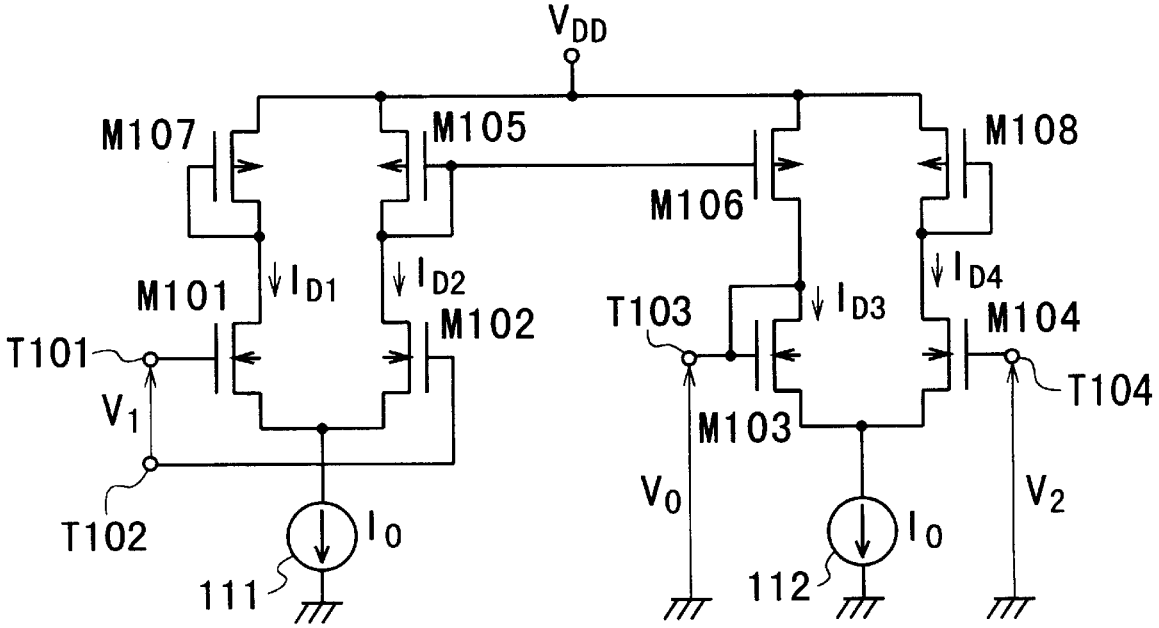
FIG. 2 PRIOR ART
FIG. 2 is a circuit diagram showing a conventional MOS voltage subtractor circuit.

With the voltage subtractor circuit according to the second embodiment, similar to the conventional one shown in FIG. 2, drain currents $I_{D1}$, $I_{D2}$, $I_{D3}$, and $I_{C4}$ of the MOSFETs M1, M2, M3, and M4 can be expressed as the above equations (9), (10), (11), and (12), respectively.

In this embodiment, the constant current source 13 providing the same constant current $I_0$ as the tail currents of the first and second differential pairs is inserted as the common load for the MOSFETs M1 and M3. Therefore, the following equation (16) is established.

$$I_{D1}+I_{D3}=I_0 \tag{16}$$

The equation (16) means that the sum of the right sides of the equations (9) and (11) is equal to the tail current $I_0$.

Substituting the above equations (9) and (11) into the equation (16) gives the above equation (14). As a result, it is seen that the circuit in FIG. 4 has a voltage subtractor function.

To improve the characteristic matching for the first and second differential pairs, it is necessary to make the drain voltages of the MOSFETs M2 and M4 equal to those of the MOSFETs M1 and M3. If the inter-terminal voltage of the constant current source 13 is set as 0.2 V, the voltage $V_{LS}$ of the constant voltage source 14 needs to be set as 0.2 V.

If each of the MOSFETs M1, M2, M3, and M4 is designed to have a threshold voltage of approximately 0.7 V, it is sufficient for normal voltage subtractor operation that the supply voltage $V_{DD}$ is equal to approximately 1.1 V (=0.2+0.7+0.2) or higher. This is lower than that of the conventional voltage adder circuit shown in FIG. 2.

Moreover, even if the constant current source 13 serving as the common active load is formed by p-channel MOSFETs, no signal current flows through the current source 13. This means that the frequency characteristic is difficult to degrade. Consequently, the linear range of the frequency characteristic of the voltage subtractor circuit according to the second embodiment becomes wider than the conventional voltage adder circuit shown in FIG. 2.

THIRD EMBODIMENT

Figure 5:
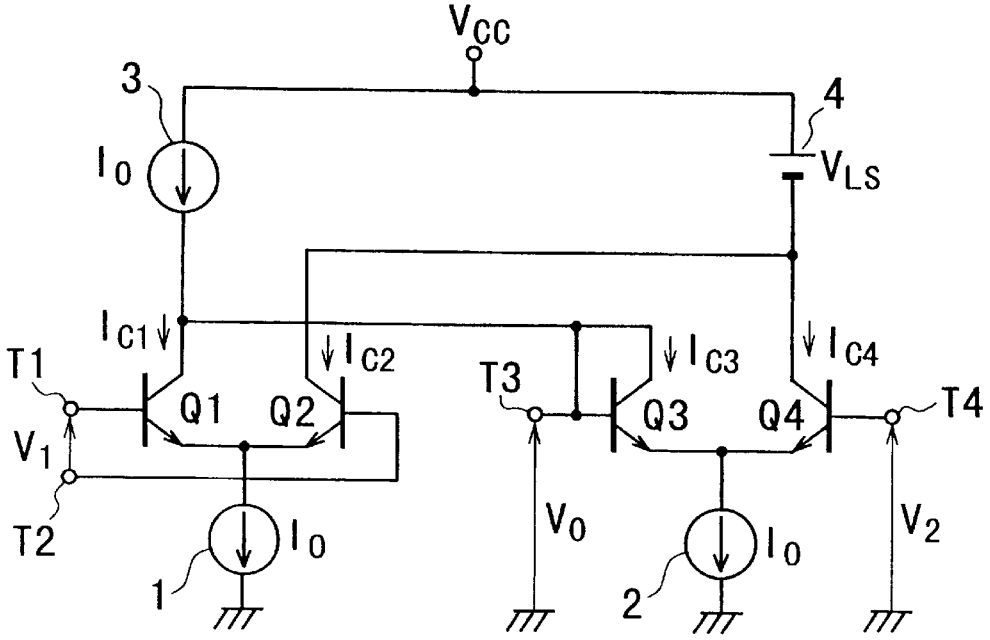
FIG. 5 is a circuit diagram showing a bipolar voltage subtractor circuit according to a third embodiment of the present invention.

A voltage subtractor circuit according to a third embodiment of the present invention is shown in FIG. 5, which has the same configuration as that of the circuit according to the first embodiment in FIG. 3, except that the coupled base and collector of the transistor Q3 are connected to the collector of the transistors Q1 and that the collector of the transistor Q4 is connected to the transistor Q2.

In the third embodiment, since the polarity of the first voltage $V_1$ is opposite to that of the first embodiment, the above equation (14) is established. Thus, it is seen that the circuit shown in FIG. 5 is a voltage subtractor circuit.

It is needless to say that the circuit according to the third embodiment has the same advantages as those in the first embodiment.

FOURTH EMBODIMENT

Figure 6:
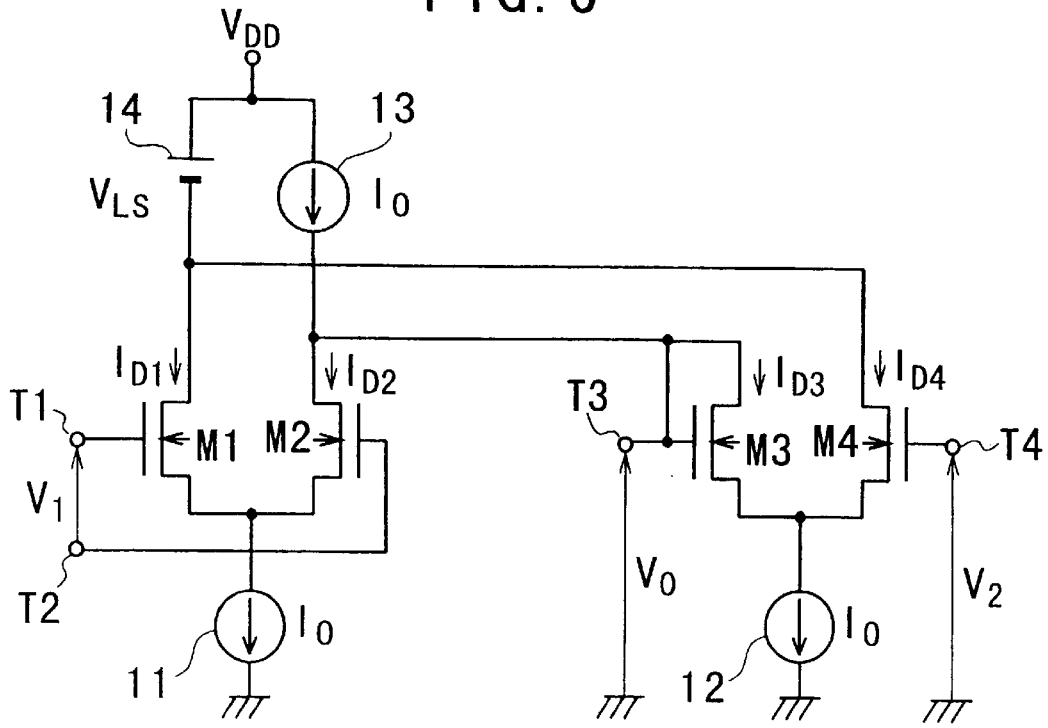
FIG. 6 is a circuit diagram showing a MOS voltage adder circuit according to a fourth embodiment of the present invention.

A voltage adder circuit according to a fourth embodiment of the present invention is shown in FIG. 6, which has the same configuration as that of the circuit according to the second embodiment in FIG. 4, except that the coupled gate and drain of the MOSFET M3 are connected to the drain of the MOSFET M2 and that the drain of the MOSFET M4 is connected to the drain of the MOSFET M1.

In the fourth embodiment, since the polarity of the first voltage $V_1$ is opposite to that of the second embodiment, the above equation (7) is established. Thus, it is seen that the circuit shown in FIG. 6 is a voltage adder circuit.

It is needless to say that the circuit according to the fourth embodiment has the same advantages as those in the second embodiment.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A voltage adder/subtractor circuit comprising:

(a) a first differential pair of first and second bipolar transistors whose emitters are coupled together;

(b) a first constant current source/sink for driving said first differential pair by a first constant current;

(c) a second differential pair of third and fourth bipolar transistors whose emitters are coupled together;

the third transistor having a base and a collector coupled together to thereby form a diode connection;

the coupled collector and base of the third transistor being connected to a collector of the second transistor;

(d) a second constant current source/sink for driving said second differential pair by a second constant current having a same current value as that of said first constant current;

(e) a third constant current source/sink serving as a common load for the second and third transistors;

said third constant current source/sink supplying/sinking a third constant current having a same current value as that of said first constant current;

said third constant current source/sink being connected to said collector of the second transistor and to the coupled collector and base of the third transistor;

(f) a first input voltage being applied between bases of the first and second transistors;

(g) a second input voltage being applied between a base of the fourth transistor and a reference point at a reference electric potential; and (h) an output voltage being derived between said base of the third transistor and said reference point.

2. The circuit as claimed in claim 1, further comprising a voltage level shifter to make collector voltages of the first and fourth transistors equal with those of the second and third transistors.

3. A voltage adder/subtractor circuit comprising:

(a) a first differential pair of first and second MOSFETs whose sources are coupled together;

(b) a first constant current source/sink for driving said first differential pair by a first constant current;

(c) a second differential pair of third and fourth MOSFETs whose sources are coupled together;

said third MOSFET having a gate and a drain coupled together to thereby form a diode connection;

the coupled drain and gate of said third MOSFET being connected to a drain of said second MOSFET;

(d) a second constant current source/sink for driving said second differential pair by a second constant current having a same current value as that of said first constant current;

(e) a third constant current source/sink serving as a common load for the second and third MOSFETs;

said third constant current source/sink supplying/sinking a third constant current having a same current value as that of said first constant current;

said third constant current source/sink being connected to said drain of said second MOSFET and the coupled drain and gate of said third MOSFET;

(f) a first input voltage being applied between gates of said first and second MOSFETS;

(g) a second input voltage being applied between a gate of said fourth MOSFET and a reference point at a reference electric potential; and (h) an output voltage being derived between said gate of said third MOSFET and said reference point.

4. The circuit as claimed in claim 3, further comprising a voltage level shifter to make drain voltages of said first and fourth MOSFETs equal with those of said second and third MOSFETs.

* * * * *